US007401997B1

(12) United States Patent
Chen

(10) Patent No.: US 7,401,997 B1
(45) Date of Patent: Jul. 22, 2008

(54) PROTRUDING ROAD WARNING DEVICE

(76) Inventor: Hsin-Min Chen, No. 63, Lane 22, Section 1, Hsin Ren Road, Taipin City, Taichung (TW)

( * ) Notice: Subject to any disclaimer, the term of this patent is extended or adjusted under 35 U.S.C. 154(b) by 0 days.

(21) Appl. No.: 11/811,756

(22) Filed: Jun. 12, 2007

(51) Int. Cl.
*E01F 9/013* (2006.01)

(52) U.S. Cl. ..... 404/11; 404/13; 404/15; 404/16

(58) Field of Classification Search ..... 404/10, 404/11, 12, 13, 14, 15, 16
See application file for complete search history.

(56) References Cited

U.S. PATENT DOCUMENTS 1,816,502 A * 7/1931 Theel ..... 404/15
1,822,916 A * 9/1931 Woods ..... 404/15
1,830,319 A * 11/1931 Hartzler et al. ..... 404/10
1,861,425 A * 5/1932 Foster ..... 404/15
1,878,691 A * 9/1932 Foster ..... 404/15
1,886,721 A * 11/1932 O'Brien ..... 404/10
2,015,031 A * 9/1935 Fischer ..... 404/15
5,215,400 A * 6/1993 Hugron ..... 404/11

* cited by examiner

*Primary Examiner*—Gary S Hartmann
(74) *Attorney, Agent, or Firm*—Jackson Walker, LLP

(57) ABSTRACT

A protruding road warning device includes a base plate, at least one mounting spike, a cushioned pad and at least one reflector. The base plate has a bottom surface, a top surface and a breakable segment. The bottom surface has multiple fastening recesses, at least one groove and at least one connecting surface. The at least one groove is defined in the bottom surface. The at least one connecting surface corresponds to and is formed respectively inside the at least one groove. The at least one break segment is formed respectively between the at least one groove and the top surface. The at least one mounting spike is connected respectively to the at least one connecting surface on the bottom surface. The cushioned pad is mounted on the top surface of the base plate. The at least one reflector is mounted on the cushioned pad.

10 Claims, 7 Drawing Sheets

PROTRUDING ROAD WARNING DEVICE

BACKGROUND OF THE INVENTION

1. Field of Invention

The present invention relates to a road warning device, and more particularly to a protruding road warning device that will not puncture tires of vehicles.

2. Description of the Related Art

Conventional protruding road warning devices like reflective lane markers, speed bumps and the like are mounted on roads to make pavement rough to indicate edges of lanes, hazardous conditions ahead and the like. Conventional protruding road warning devices like speed bumps and hazard indicators are usually mounted perpendicular to the flow of traffic.

A conventional protruding road warning device has a flat bottom and usually has a spike. The spike is formed on and protrudes from the bottom and is driven into pavement to securely mount the protruding road warning device on a road. However, when a vehicle brakes, vehicle tire exert a severe lateral force on the conventional protruding road warning device, which may rip the protruding road warning device from the pavement and expose the spike. The exposed spike constitutes an imminent hazard to traffic and will likely puncture some vehicle's tire. Puncturing a tire at high speed will almost certainly result in loss of control of the vehicle and cause serious damage to the vehicle and injuries to and casualties of passengers in the vehicles.

To overcome the shortcomings, the present invention provides a protruding road warning device to mitigate or obviate the aforementioned problems.

SUMMARY OF THE INVENTION

The primary objective of the present invention is to provide a protruding road warning device that will not puncture tires of vehicles.

A protruding road warning device in accordance with the present invention comprises a base plate, at least one mounting spike, a cushioned pad and at least one reflector. The base plate has a bottom surface, a top surface and at least one breakable segment. The bottom surface has at least one groove, at least one connecting surface and multiple recesses. The at least one groove is defined in the bottom surface. The at least one connecting surface corresponds to and is formed respectively inside the at least one groove. The recesses are defined in the bottom surface. The at least one breakable segment is formed respectively between the at least one groove and the top surface of the base plate.

The at least one mounting spike is connected respectively to the at least one connecting surface on the bottom surface. The cushioned pad is mounted on the top surface of the base plate and has a convex outer surface. The at least one reflector is mounted on the outer surface of the cushioned pad.

Other objectives, advantages and novel features of the invention will become more apparent from the following detailed description when taken in conjunction with the accompanying drawings.

DETAILED DESCRIPTION OF THE INVENTION

With reference to FIGS. 1 to 7, a protruding road warning device in accordance with the present invention comprises a base plate (10, 10A, 10B, 10C, 10D, 10E), at least one mounting spike (20, 20A, 20B, 20C, 20D, 20E), a cushioned pad (30) and at least one reflector (40).

Figure 4:
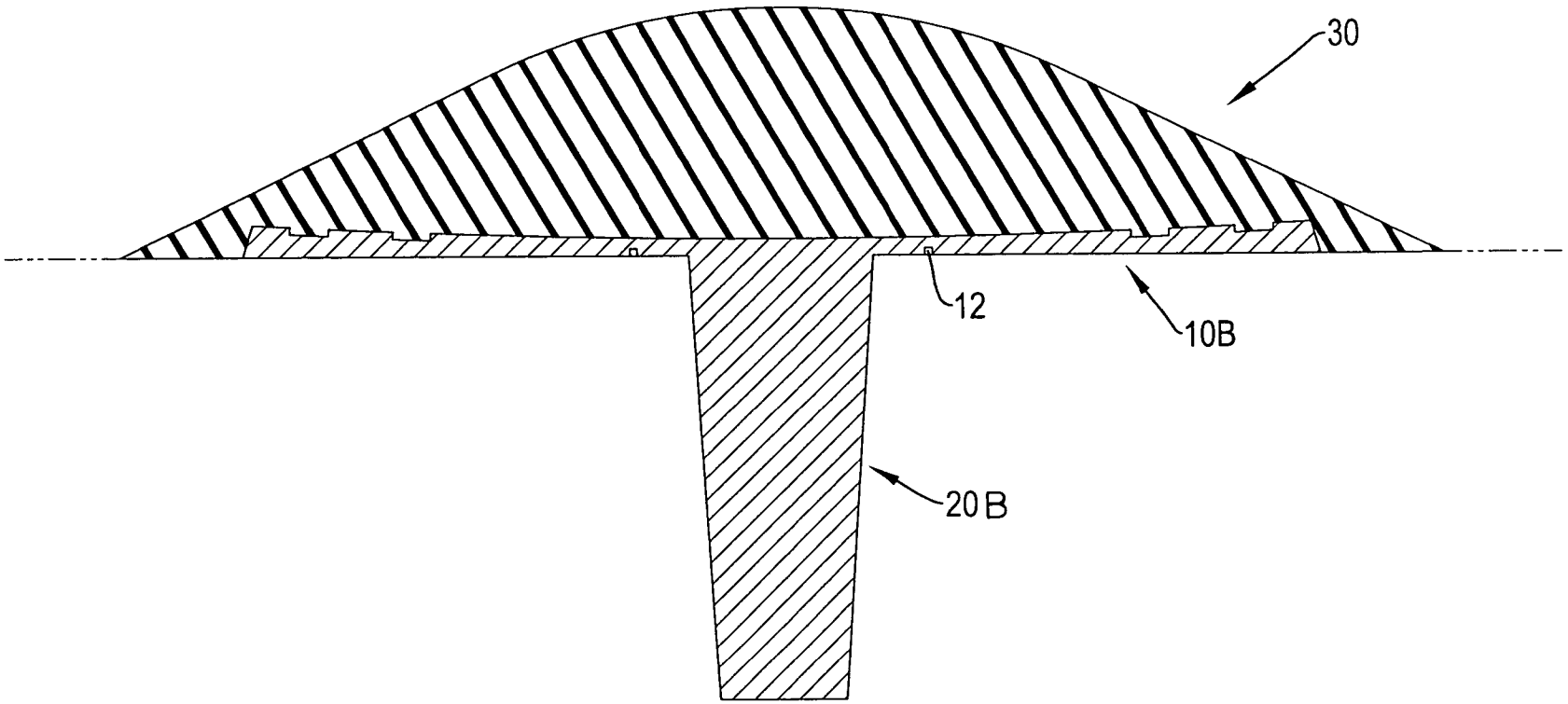
FIG. 4 is a cross-sectional side view of a third embodiment of a protruding road warning device in accordance with the present invention.

The base plate (10, 10A, 10B, 10C, 10D, 10E) has a middle, an edge, a bottom surface a top surface and at least one breakable segment, may be square or rectangular and may have a longitudinal concave recess (15). The middle of the base plate (10A, 10B) may be thinner than the edge of the base plate (10A, 10B). The bottom surface is attached to a road (50) by an adhesive and has a center, two sides, multiple fastening recesses (11), at least one groove (12, 12A) and at least one connecting surface and may have an inner recess (13), an outer recess (14) or a curved recess. The fastening recesses (11) are defined in the bottom surface to increase area to which the adhesive bonds and improve the bonding effect. The at least one groove (12, 12A) is defined in the bottom surface, and each one of the at least one annular groove (12, 12A) may be circular or rectangular. When the base plate (10, 10D) is square, the groove (12, 12A) is defined in the center of the bottom surface. When the base plate (10C) is rectangular, six grooves (12) or more may be evenly divided and formed adjacent to two sides of the bottom surface. The at least one connecting surface corresponds to and is formed respectively inside the at least one groove (12, 12A) in the bottom surface. The inner recess (13) is defined around the center of the bottom surface and has a depth of 0.3 mm. The outer recess (14) is defined in the bottom surface around the inner recess (13) and has a depth of 0.3 mm. So the middle of the base plate (10A) is thinner than the edge of the base plate (10A) by means of the inner recess (13) and the outer recess (14) as shown in FIG. 4. In addition, the curved connecting recess is defined in the bottom surface so as to make the middle of the base plate (10B) thinner than the edge of the base plate (10B). Consequently, the middle of the base plates (10A, 10B) is thinner than the edges of the base plates (10A, 10B). The concave recess (15) is formed longitudinally in the middle of the base plate (10C). The at least one breakable segment is formed respectively between the at least one groove (12, 12A) and the top surface of the base plate (10, 10A, 10B, 10C, 10D, 10E).

Figure 8:
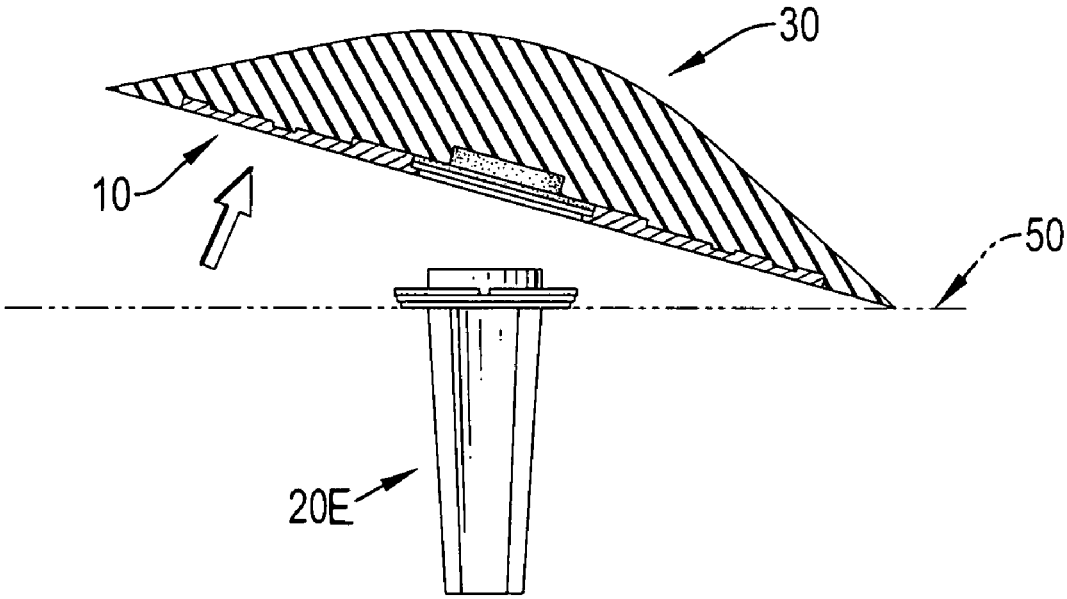
FIG. 8 is an operational side view in partial section of the sixth embodiment of the protruding road warning device in FIG. 7 being ripped off.

With further reference to FIG. 8, the at least one mounting spike (20, 20A, 20C, 20D, 20E) is connected respectively to the at least one connecting surface on the bottom surface and is driven into the road (50) to hold the protruding road warning device securely on the surface of the road (50). When the protruding road warning device is ripped off the road (50), the breakable segment of the base plate (10E) will break and the mounting spike (12) will remain in the road (50) and will not be a hazard to vehicles.

Figure 1:
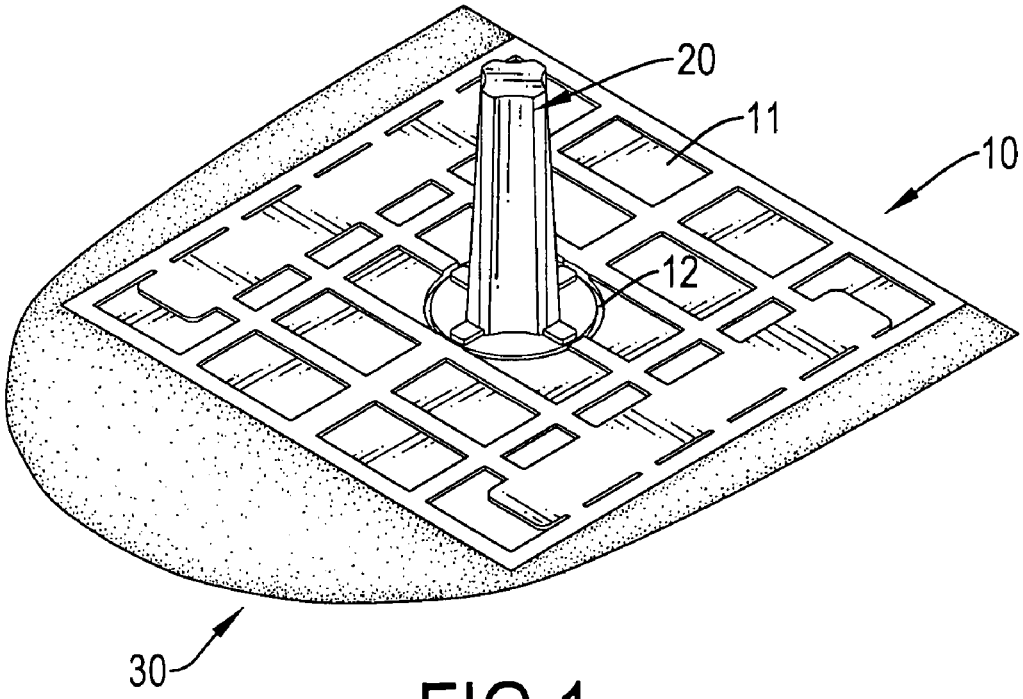
FIG. 1 is a bottom perspective view of a first embodiment of a protruding road warning device in accordance with the present invention.
Figure 2:
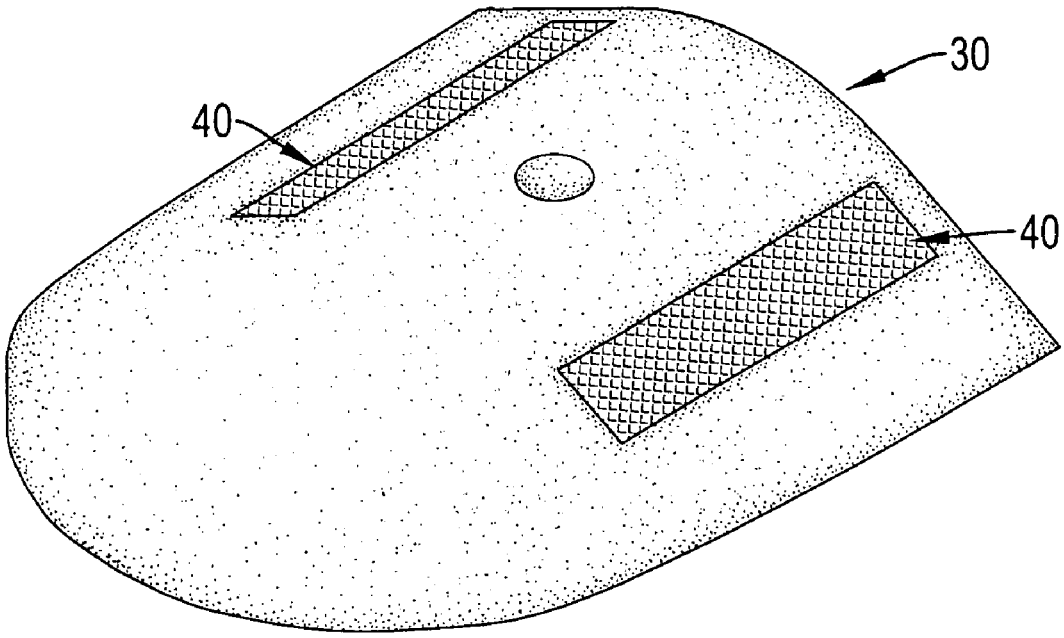
FIG. 2 is top perspective view of the protruding road warning device in FIG. 1.
Figure 3:
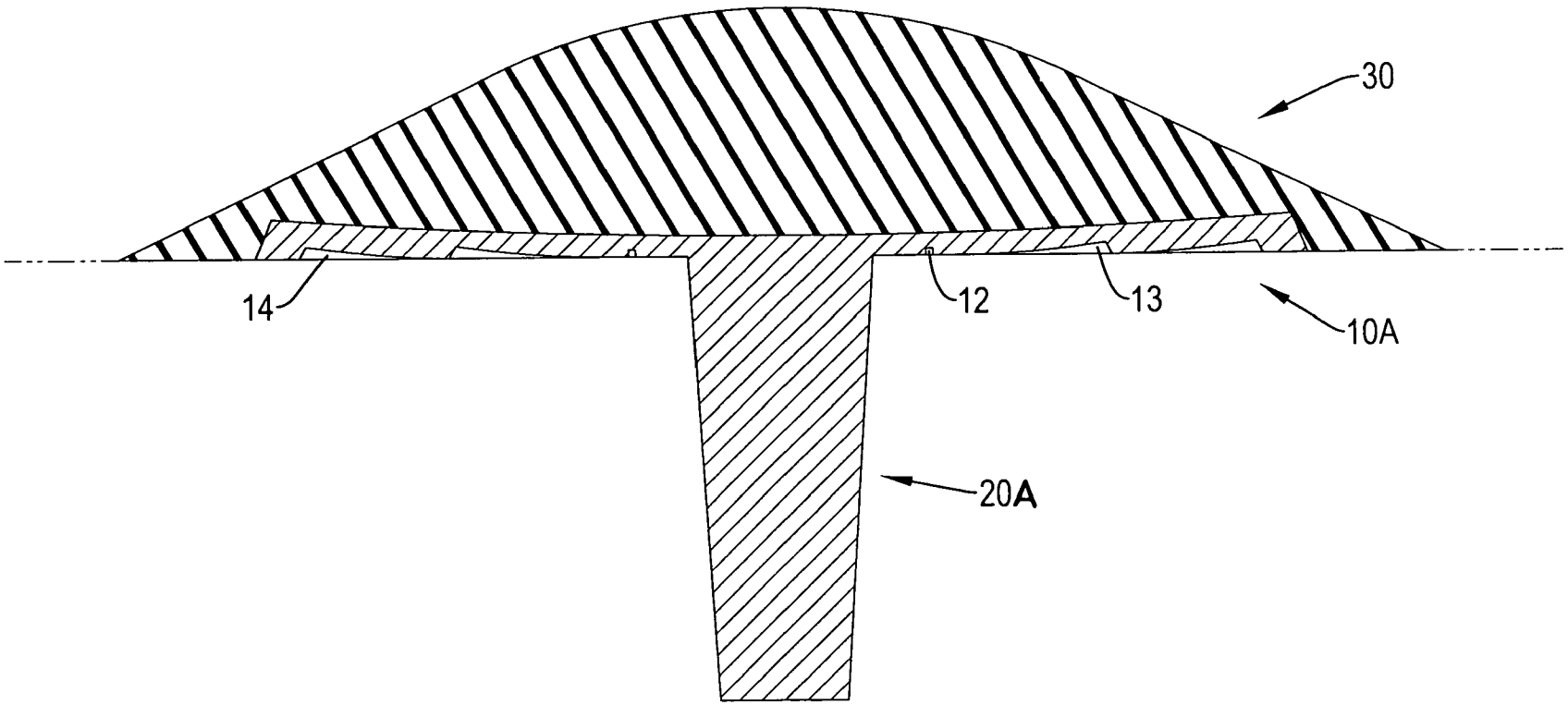
FIG. 3 is a cross-sectional side view of a second embodiment of a protruding road warning device in accordance with the present invention.
Figure 5:
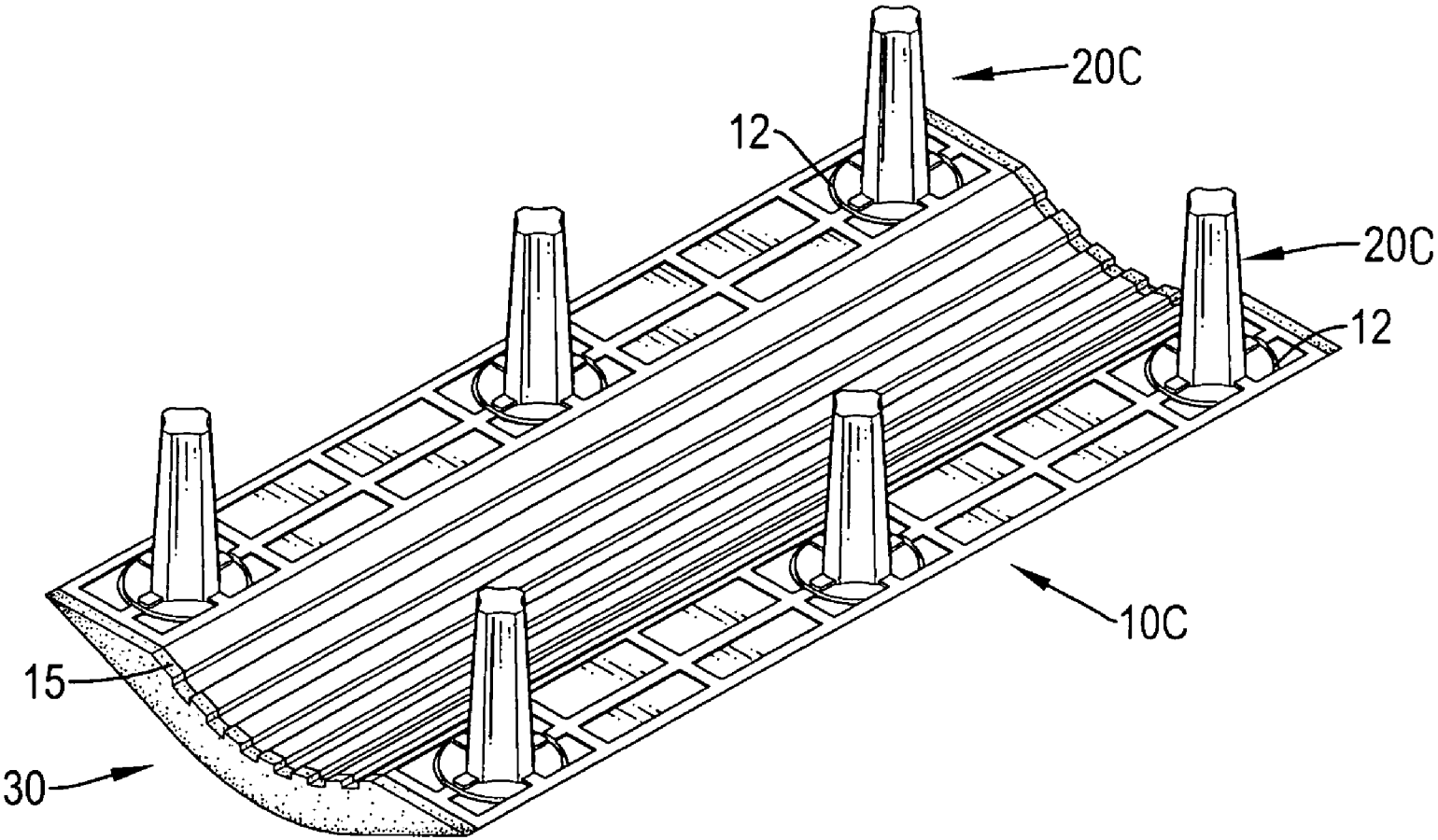
FIG. 5 is a bottom perspective view of a fourth embodiment of a protruding road warning device in accordance with the present invention.
Figure 6:
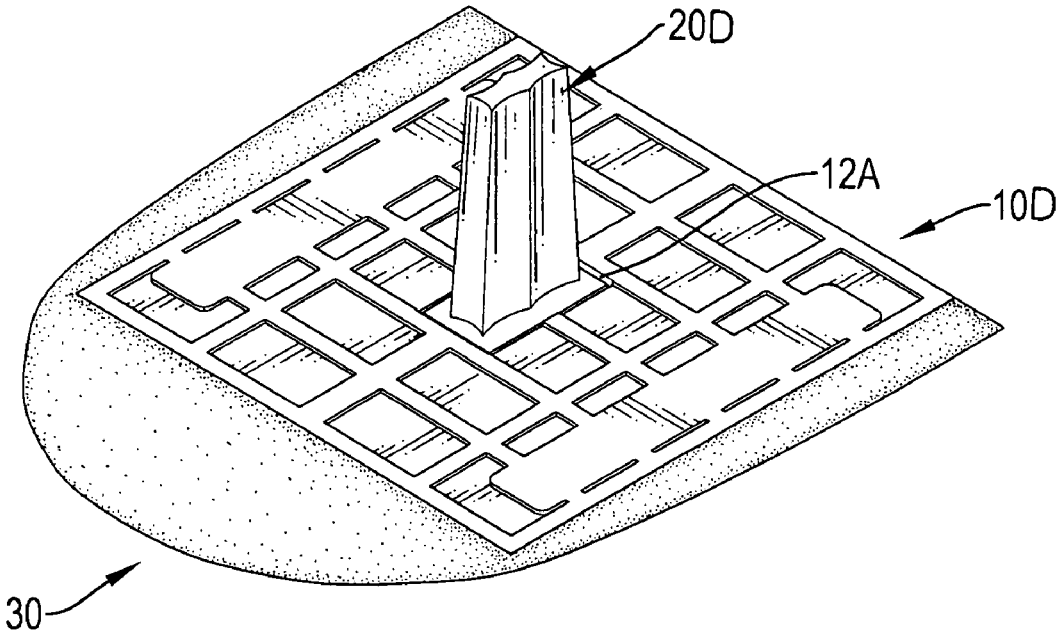
FIG. 6 is a bottom perspective view of a fifth embodiment of a protruding road warning device in accordance with the present invention.
Figure 7:
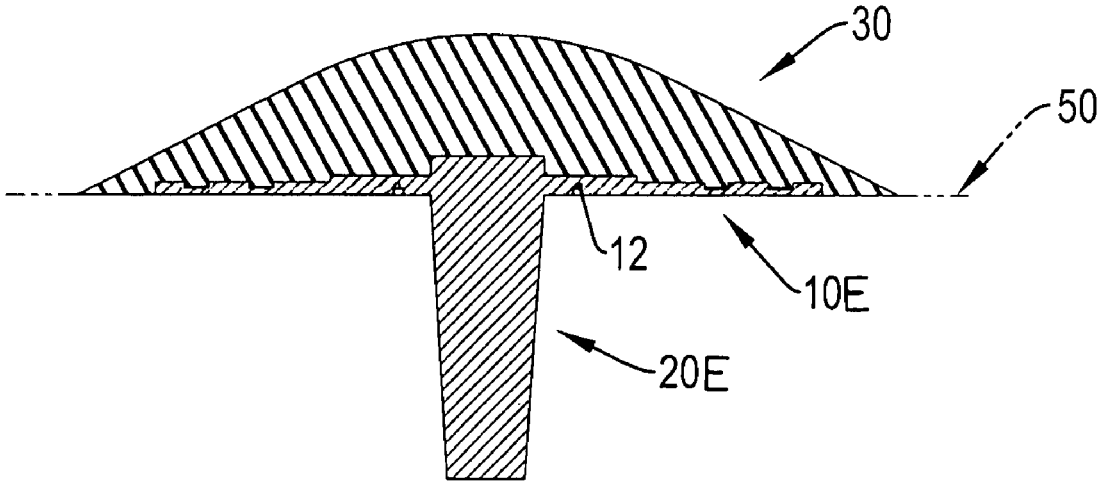
FIG. 7 is a cross-sectional side view of a sixth embodiment of a protruding road warning device in accordance with the present invention.

Each one of the at least one mounting spike (20, 20A, 20B, 20C, 20D, 20E) may has a substantially square or rectangular cross-section and four side faces. When each one of the at least one mounting spike (20, 20C) has a substantially square cross-section as shown in FIGS. 1 and 5, each side face has a concave and longitudinal recess. When each one of the at least one mounting spike (20D) has a substantially rectangular cross-section as shown in FIG. 6, each one of the at least one mounting spike (20D) has two short side faces and two long side faces. Each short side face has a concave and longitudinal recess. Each long side face has two concave and longitudinal recesses adjacent to each other.

The cushioned pad (30) can be made of rubber and is mounted on the top surface of the base plate (10, 10A, 10B, 10C, 10D, 10E) and has a curved outer surface having two sides. When vehicles pass over the cushioned pad (30) mounted on a road (50), the cushioned pad (30) causes vehicle tires to bump and warn drivers of a potential hazard. The cushioned pad (30) is formed on the base plate (10, 10A, 10B, 10C, 10D, 10E) with hot rubber. The hot rubber shrinks as it cools down, which causes the base plate (10, 10A, 10B, 10C, 10D, 10E) connected to the cushioned pad (30) to deform and bend toward the cushioned pad (30). Therefore, if the middle of the base plate (10A, 10B) is thinner than the edge of the base plate (10A, 10B), the bottom surface will become substantially flat after the deformation of the base plate (10A, 10B). Then the bottom surface of the base plate (10A, 10B) can be attached to the road (50) more securely.

The at least one reflector (40) is mounted on the outer surface of the cushioned pad (30) and can reflect light from vehicles to provide a visual warning to drivers. Reflectors (40) may be mounted respectively on the sides of the outer surface of the cushioned pad (30).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A protruding road warning device comprising
a base plate having
a middle;
an edge;
a bottom surface having
a center;
two sides;
multiple fastening recesses being defined in the bottom surface;
at least one groove being defined in the bottom surface; and
at least one connecting surface corresponding to and being formed respectively inside the at least one groove in the bottom surface; and
a top surface; and
at least one breakable segment be formed respectively between the at least one groove and the top surface;
at least one mounting spike being connected respectively to the at least one connecting surface in the bottom surface;
a cushioned pad being mounted on the top surface of the base plate and having a curved outer surface having two sides; and
at least one reflector being mounted on the outer surface of the cushioned pad.

2. The protruding road warning device as claimed in claim 1, wherein
each one of the at least one groove is circular; and
each one of the at least one mounting spike has
a square cross-section, and
four side faces, and each side face having a concave and longitudinal recess.

3. The protruding road warning device as claimed in claim 2, wherein
the base plate is square; and
the bottom surface of the base plate has a groove defined around the center of the bottom surface.

4. The protruding road warning device as claimed in claim 3, wherein
the middle of the base plate is thinner than the edge of the base plate.

5. The protruding road warning device as claimed in claim 4, wherein
the bottom surface of the base plate further has
an inner recess defined in the center of the bottom surface; and
an outer recess being defined on the bottom surface around the inner recess.

6. The protruding road warning device as claimed in claim 5 has two reflectors mounted respectively on the sides of the outer surface of the cushioned pad.

7. The protruding road warning device as claimed in claim 1, wherein
each one of the at least one groove is rectangular; and
each one of the at least one mounting spike has
a rectangular cross-section,
two short side faces, and each side face having a concave and longitudinal recess; and
two long side faces, and each side face having two concave and longitudinal recesses adjacent to each other.

8. The protruding road warning device as claimed in claim 2, wherein
the base plate is rectangular and further has a concave recess formed longitudinally in the middle of the base plate; and
the bottom surface of the base plate has multiple grooves defined in the sides of the bottom surface.

9. The protruding road warning device as claimed in claim 1, wherein
the base plate is square; and
the bottom surface of the base plate has a groove defined in the center of the bottom surface.

10. The protruding road warning device as claimed in claim 1 has two reflectors mounted respectively on the sides of the outer surface of the cushioned pad.

* * * * *